US005188409A

United States Patent [19]

Forey

[11] Patent Number: 5,188,409

[45] Date of Patent: Feb. 23, 1993

[54] GOLF BALL RETRIEVER

[76] Inventor: Daniel J. Forey, 2190 Willow La., Lakewood, Colo. 80215

[21] Appl. No.: 902,433

[22] Filed: Jun. 18, 1992

Related U.S. Application Data

[63] Continuation of Ser. No. 606,874, Oct. 31, 1990, abandoned.

[51] Int. Cl.[5] ..... A63B 47/02

[52] U.S. Cl. ..... 294/19.2; 273/32 F

[58] Field of Search ..... 294/19.1, 19.2, 99.1; 16/114 R, 115; 81/177.2; 273/32 B, 32 E, 32 F, 162 R, 162 B, 162 E, 162 F

[56] References Cited

U.S. PATENT DOCUMENTS

| | | | |
|---|---|---|---|
| 1,674,294 | 6/1928 | O'Rourke | 294/19.2 |
| 2,204,482 | 6/1940 | Filipiak | 294/19.2 |
| 2,218,825 | 10/1940 | Le Guillou | 294/19.2 |
| 2,724,610 | 11/1955 | Fitzgerald | 294/19.2 X |
| 3,922,026 | 11/1975 | Schweitzer | 294/19.2 |
| 4,216,831 | 8/1980 | Ritchie | 294/19.2 X |
| 4,509,751 | 4/1985 | Tabet | 294/19.2 X |
| 4,659,125 | 4/1987 | Chuan | 294/19.2 |
| 4,733,681 | 3/1988 | Lee | 294/19.2 X |

FOREIGN PATENT DOCUMENTS

| | | | |
|---|---|---|---|
| 2074926 | 11/1981 | United Kingdom | 294/19.2 |

*Primary Examiner*—Johnny D. Cherry
*Attorney, Agent, or Firm*—John E. Reilly

[57] ABSTRACT

A golf ball retrieving device comprises a set of short telescoping tubular shafts which, when collapsed, will fit easily in a pocket of a golf bag or the like. The base shaft section is provided with an open cylindrical socket at its base end. The socket has a lengthwise slot on its side opposite the base section through which the metal shaft of a golf club may be introduced. The socket may then be moved along the club shaft until the gripping handle of the shaft enters the socket and the increasing thickness thereof may be pressed into firm engagement with the socket. The combined club shaft and the telescoping sections may thus be extended to provide a ball retrieving shaft two or three times the length of the club shaft alone. A ball pick-up device, which may be a ring having an internal diameter a little less than the diamemter of a golf ball, is mounted at the outer end of the end section so that a ball may be engaged by the user and picked up at a substantial distance from the user.

7 Claims, 1 Drawing Sheet

GOLF BALL RETRIEVER

This application if a continuation application of Ser. No. 07/606,874, filed 31 Oct., 1990, now abandoned, for GOLF BALL RETRIEVER, invented by Daniel J. Forey.

This invention relates to devices for retrieving golf balls from bodies of water and from other relatively inaccessible places.

Various devices have been provided heretofore for retrieving golf balls which have landed in relatively inaccessible places such as in bodies of water and in brush or the like. Some of these devices have embodied telescoping shafts with end devices for engaging and holding a golf ball. Some retrieving devices have been constructed for mounting on a golf club which thus becomes a part of the retrieving device. These devices may be made to reach and retrieve a ball at distances of ten feet or substantially more. For example, U.S. Pat. No. 3,922,026 to Schweitzer and British patent application No. 2,074,926 disclose ball retrieving members which are releasably secured by a spring clip to the grip end of a golf club, but neither is concerned with the problem of leverage in extending a series of telescoping rod sections away from the golf shaft. Furthermore, in Schweitzer, the retrieving element must be forced in an axial direction over the ball to be retrieved rather than by scooping the ball in a direction which would impart a transverse force to the retrieving element. Other representative patents are those to O'Rourke U.S. Pat. No. 1,674,294 and Chuan U.S. Pat. No. 4,659,125 but neither is concerned with the problem of mounting of a telescoping retriever at the handle end of a golf club and in such a way as to permit utilization of a scoop-type retriever element at the distal end of the telescoping sections. In this way, when a lifting force is applied in a direction normal or transverse to the length of the telescoping rod sections in retrieving a golf ball from the water, it is important to prevent separation of the connecting end of the retriever from the handle end of the golf club. A particular advantage of utilizing a telescoping extension at the end of the golf club in combination with a rigid connecting end is to permit fishing balls out of the water without submerging the gripping handle or any part of the golf club itself in the water; yet, at the same time, the added handle length permits utilization of a lighter weight, smaller retriever which can be easily stored in a pocket of the golf bag.

It is desirable that the retrieving device be readily carried for use when needed and it is an object of this invention to provide a retrieving device that takes up minimum space and that it be easy to carry and be readily available when needed.

It is another object of this invention to provide a golf ball retrieving device which uses a golf club as a part of the device and which may be easily attached to a club when needed without requiring the use of a tool for securing the device to the club.

It is an additional object of the present invention to provide for a novel and improved telescoping golf ball retriever which may be securely but releasably connected to the grip end of a golf club so that the retriever end may be extended for a substantial distance away from the end of the golf club in retrieving golf balls from the water and other inaccessible places without accidentally separating the connecting end of the retriever from the grip end of the golf club.

Further objects and advantages of this invention will become apparent as the following description proceeds and the features of novelty which characterize this invention will be pointed out with particularity in the claims annexed to and forming a part of this specification.

BRIEF SUMMARY OF THE DISCLOSURE

Briefly, the golf ball retrieving device disclosed herein comprises a telescoping shaft having a base end arranged to be attached to the gripping handle of a golf club and having a plurality of telescoping sections with a ball engaging and pick-up device secured to the outermost section to receive and hold the ball while it is retrieved. The base end is provided with means for attaching it to a golf club gripping handle. The attaching means comprises a generally cylindrical sleeve, welded or otherwise securely attached to the base end, and having a longitudinal slot opening on its side opposite the base so that the shaft of a golf club may easily be moved laterally into the sleeve. The club shaft may then be moved into the sleeve and along the base end until the enlarged end of the handle is securely held by the sleeve. The telescoping sections may then be extended several feet so the club may be held in the head area directing the pick-up device into engagement with the ball whereupon the ball may be picked up and retrieved.

DETAILED DESCRIPTION

Figures 1, 2, 3, 4:
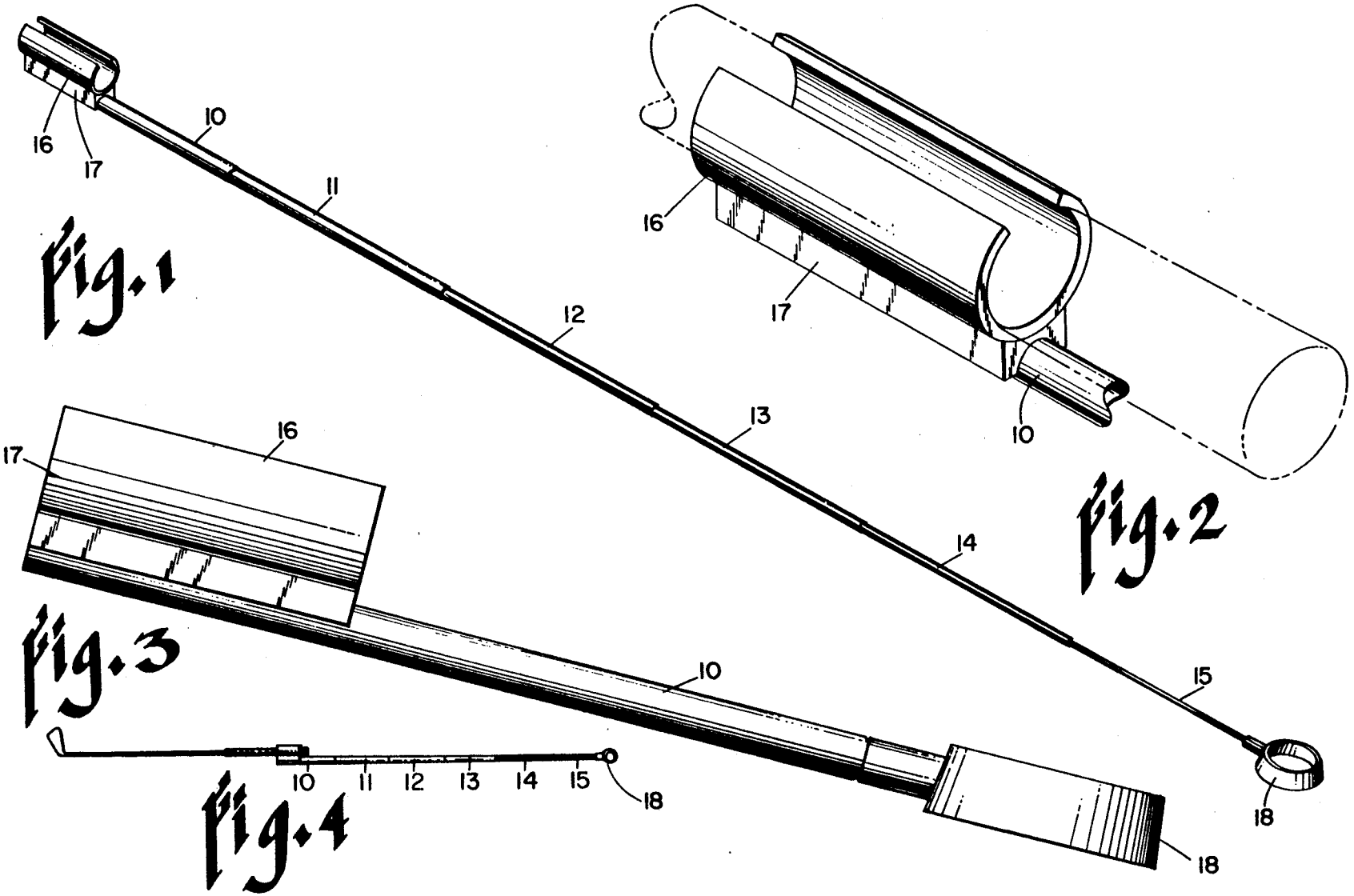
FIG. 1 is a perspective view of the retriever with the telescoping sections extended.
FIG. 2 is an enlarged perspective view of the attaching sleeve mounted on the base section or end.
FIG. 3 is an enlarged side elevation view of the retriever with the telescoping sections collapsed and the ball engaging device partly broken away, to show the inner wall configuration.
FIG. 4 is a greatly reduced side elevation view of the assembled device mounted on an iron with the sections extended.

Referring now to the drawing, FIG. 1 illustrates a series of telescoping sections, 10, 11, 12, 13, 14 and 15, in their extended positions. The section 10 is the base end and is provided with a cylindrical sleeve 16 welded or otherwise securely attached to the section 10. The sleeve has a rigid base 17 securely attached thereto and to the end portion of the section 10. The internal diameter of the sleeve is somewhat less than the diameter of the larger portion of the hand grip of a golf club. When connecting the telescoping section to the grip handle of a golf club, the metal shaft of the club is placed in the slot in alignment with the section 10 and is then moved along the handle toward the larger end of the grip. The gripping handle of the club is then pressed longitudinally into the sleeve until it is securely held therein as indicated in FIG. 2 which shows in dotted lines a club handle in place in the sleeve. By pressing the club handle into the sleeve 16, the club is held securely in place by the compressive resistance of the material of the grip. No tool is required. The club shaft and the extended telescoping sections when secured together provide a ball retrieving rod much longer than the club shaft; the overall length of the retrieving device thereby formed may, for example, be of the order of two to three times the length of a golf club, so that, when the sleeve is pressed along the shaft onto the enlarged end of the hand grip, the sleeve and grip are held tightly together thereby securing the retrieving device to the golf club.

The ball engaging and pick-up device, indicated at 18, is attached to the outer end of the section 15. It will be evident that in retrieving a ball in the water, a substantial lifting force is applied in a direction normal or transverse to the length of the telescoping rod sections 10–15 thereby creating a substantial force at the connecting end 16 tending to separate the connecting end 16 from the gripping handle of the golf club. It is therefore important that the sleeve 16 not only be securely attached to the section 10 but also that the gripping handle be securely held therein as previously described so as to prevent accidental separation of the retriever from the club. This device 18 has been illustrated in the form of a scoop-type device defined by a ring which is a frustum of a cone, and is illustrated as partially broken away to show the interior configuration.

The design of the retriever will, of course, vary depending upon its intended field o: use, and the requirements of the user. The telescoping sections may be varied in length and in number. The retriever illustrated in the drawing may have a section length of, say, nine inches which, when collapsed, may be carried in a pocket of the golf bag. Longer sections may be used when a retriever of greater reach is desired.

While a particular embodiment of this invention has been illustrated and described, other applications and arrangements will occur to those skilled in the art. Therefore, it is not desired that this invention be limited to the specific construction shown and described and it is intended by the accompanying claims to cover all modifications within the spirit and scope of the invention.

I claim:

1. A golf ball retriever device adapted for removable attachment to a golf club for retrieving a golf ball wherein said golf club includes a shaft and a golf club gripping handle having a smaller diameter portion and a larger diameter portion, said device comprising a rod having a base and a ball-receiving end, a scoop-type ball retriever element on said ball-receiving end, and said rod having a plurality of telescoping tubular members slidable between an extended position and a retracted position, and securing means on said base for securing said base to said gripping handle of the golf club, said securing means including an elongated tubular, substantially rigid body having an internal diameter greater than that of said shaft of the golf club and less than that of said larger diameter portion of said gripping handle, said tubular body being elongated in a direction parallel to said rod and including golf club shaft receiving means in the form of an open slot extending the length of said body, said receiving means receiving said shaft of the golf club by lateral movement of said shaft through said open slot into said body and advancing said body along said shaft and toward said larger diameter portion of said gripping handle until said body fits tightly on said gripping handle with said rod extending axially beyond said handle whereby said telescoping tubular members may be slidably advanced to the extended position to cooperate with said golf club in defining an extended ball-retrieving member of substantial length.

2. A golf ball retriever device according to claim 1, wherein said telescoping members in the retracted position are of a length corresponding to a pocket of a golf bag.

3. A golf ball retriever device according to claim 1, said base disposed in diametrically opposed relation to said open slot.

4. A golf ball retriever device according to claim 1, said telescoping members being collapsible into said base of said rod in the retracted position.

5. A golf ball retriever adapted for removable attachment to a golf club for retrieving a golf ball wherein the golf club includes a shaft and a golf club gripping handle having a smaller diameter portion and a larger diameter portion, said retriever comprising a rod having a base and a ball-receiving end, a scoop-type ball retriever element on said ball-receiving end, and said rod having a plurality of telescoping tubular members slidable between an extended position and a retracted position, and securing means on said base for securing said base to said gripping handle of the golf club, said securing means including an elongated tubular body coextensive with said base having an internal diameter greater than that of said shaft of the golf club and less than that of said larger diameter portion of said gripping handle, said tubular body being elongated in a direction parallel to said rod and including golf club shaft receiving means in the form of an open slot extending the length of said body, said open slot sized for receiving said shaft of the golf club by lateral movement of said shaft through said open slot into said body and advancing said body lengthwise along said shaft and over said gripping handle toward the larger diameter portion of said gripping handle until said body fits tightly on said gripping handle with said rod extending axially beyond said handle whereby said telescoping tubular members may be slidably advanced to the extended position to cooperate with said golf club in defining an extended ball-retrieving member of substantial length, said gripping handle being securely held in said body to prevent separation of said body from said golf club when a force normal to said rod is applied to said rod in retrieving a golf ball.

6. A golf ball retriever according to claim 5, said tubular members being collapsible into said base of said rod in the retracted position and capable of extension a distance two to three times the length of said golf club shaft in the extended position.

7. A golf ball retriever according to claim 5, said base disposed in diametrically opposed relation to said open slot and said rod extending parallel to said tubular body.

* * * * *